US006125755A

United States Patent [19]

Link et al.

[11] Patent Number: 6,125,755

[45] Date of Patent: Oct. 3, 2000

[54] PROCESS FOR PRINTING A CARRIER MATERIAL

[75] Inventors: Robert Link, Traunstein; Manfred Wiedemer, Ismaning; Joachim Heinzl, Munich, all of Germany

[73] Assignee: Océ Printing Systems GmbH, Poing, Germany

[21] Appl. No.: 09/142,881

[22] PCT Filed: Mar. 13, 1997

[86] PCT No.: PCT/DE97/00508

§ 371 Date: Dec. 14, 1998

§ 102(e) Date: Dec. 14, 1998

[87] PCT Pub. No.: WO97/36746

PCT Pub. Date: Oct. 9, 1997

[30] Foreign Application Priority Data

Mar. 29, 1996 [DE] Germany ..... 196 12 761

[51] Int. Cl.[7] ..... B41C 1/10; B41F 7/30

[52] U.S. Cl. ..... 101/451; 101/147; 101/467; 101/478

[58] Field of Search ..... 101/132.5, 147, 101/148, 450.1, 451, 467, 478, 487

[56] References Cited

U.S. PATENT DOCUMENTS

| | | | |
|---|---|---|---|
| 2,002,815 | 5/1935 | Harrold | 101/147 |
| 2,101,202 | 12/1937 | Stevens | 101/147 |
| 3,072,049 | 1/1963 | Huebner | 101/147 |
| 3,800,699 | 4/1974 | Carley | 101/147 |
| 4,010,686 | 3/1977 | Harris | 101/148 |
| 4,188,882 | 2/1980 | Jeschke et al. | 101/148 |
| 4,833,990 | 5/1989 | Hirt et al. | 101/130 |

FOREIGN PATENT DOCUMENTS

| | | |
|---|---|---|
| 0 262 475 | 4/1988 | European Pat. Off. . |
| 0 522 804 | 1/1993 | European Pat. Off. . |
| 286 137 | 2/1953 | Germany . |
| 719239 | 1/1954 | United Kingdom . |
| 2 002 132 | 4/1979 | United Kingdom . |

*Primary Examiner*—Stephen R. Funk
*Attorney, Agent, or Firm*—Hill & Simpson

[57] ABSTRACT

In a printing method and system for production of a print image on a carrier material, a print carrier is provided, a surface of which is charged with water vapor at locations corresponding to structures of the print image to be printed. Water vapor is condensed at these locations as a film of water. Ink is applied to the surface, the ink adhering to non-wetted locations and not being accepted by the wetted locations. The ink from the non-wetted locations is printed onto the carrier material.

18 Claims, 1 Drawing Sheet

PROCESS FOR PRINTING A CARRIER MATERIAL

BACKGROUND OF THE INVENTION

The invention relates to a printing method for producing a print image on a carrier material, in which a print carrier is provided whose surface is charged with water vapor in a manner corresponding to the structure of the print image to be printed.

In known printing methods, such as the offset printing method, partial printing regions corresponding to the print image to be printed are provided on the surface of a print carrier, e.g. a print plate, a printing strip or a print master, which regions are inked with ink during the print process and subsequently print the carrier material with the ink. Various methods are known for the formation of these partial printing regions. For example, in the direct imaging method of the company Heidelberger Druckmaschinen, a print master is produced on a silicon-coated film by partially burning away the silicon layer, and the silicon-free locations accept the ink during the print process and print the carrier material. In another known method, hydrophobic and hydrophilic regions corresponding to the structure of the print image to be printed are produced on the print carrier. Before the application of ink to the print carrier, a thin film of moisture is first applied to the print carrier using application rollers or, respectively, spraying systems, which film wets the hydrophilic regions of the print carrier. Subsequently, using an ink roller, ink is applied to the surface of the print carrier, which however uses exclusively the regions not covered with a film of moisture. After the inking of the print carrier, the inked print image is finally transferred to the carrier material.

From U.S. Pat. No. 3,072,049 and U.S. Pat. No. 2,002,815, printing systems are known that respectively operate according to a printing method in which in order to produce the thin film of moisture on the surface of the print carrier, instead of using application rollers or spraying systems water vapor is applied to the hydrophilic regions of the print carrier. Here as well, the surface of the print carrier, which is charged with water vapor, is divided into hydrophobic and hydrophilic regions corresponding to the structures of the print image to be printed.

The printing methods described above all have in common that a print carrier has to be used on a surface of which raised and flat regions, or hydrophobic and hydrophilic regions, are provided corresponding to the structures of the print image to be printed.

SUMMARY OF THE INVENTION

An object of the invention is to provide a flexible printing method in which the print image to be printed can be modified in a simple manner.

This object is achieved by means of a printing method for production of a print image on a carrier material where a print carrier is provided, a surface of which is charged with water vapor at locations corresponding to structures of the print image to be printed. Water vapor is condensed at the locations corresponding to the structures of the print image as a film of water. Ink is applied to the surface, the ink adhering to non-wetted locations and not being accepted by the wetted locations. The ink is printed from the non-wetted locations onto the carrier material.

By means of the invention, a printing method is provided in which the surface of the print carrier is selectively and partially charged with water vapor in such a way that a partial water film that yields the print image forms on the surface. Given the use of this printing method, the use of a print carrier on whose surface hydrophilic and hydrophobic regions are provided can be dispensed with, so that additional operational steps are omitted. In place of the chemically pre-treated print carrier, the printing method with selective use of water uses a print carrier with a uniform surface onto which the film of water yielding the print image is applied. By this technique, it is possible to modify the print master within a print process, so that the printing method operates with very high flexibility.

In a further embodiment of this printing method, the use of an intermediate carrier, for example a rubber sheet or a roller with a rubberized surface, is additionally proposed, which is adapted to the different carrier materials used.

For the selective and partial charging of the surface of the print carrier with water vapor, in a development of the method a strip of fabric moistened with water is arranged opposite the surface of the print carrier, and is selectively heated at locations corresponding to the print image, using a source of radiation, e.g. a laser with a deflection and focusing optics, high-temperature lamps or laser diode arrays, and/or a source of heat, such as heating elements, thermocombs or microwave elements. In this way, on the side of the strip of fabric facing the surface of the print carrier, water will emerge as steam at the correspondingly heated locations, and will condense on the surface of the print carrier. In order to moisten the strip of fabric with water, it is guided in a continuous movement e.g. through a roller system and/or a spray unit. Of course, it is also conceivable to move the strip of fabric through a water bath, whereby the strip of fabric absorbs water due to capillary action.

In a further embodiment of the method, instead of a moistened strip of fabric, a vaporization unit with a supply of water is arranged opposite the surface of the print carrier. The vaporization unit has a large number of recesses filled with water in which at least one heating element is respectively provided that can be actuated independent of the other heating elements. By the application of impulses, the heating elements are selectively activated so that the water located in the recess is vaporized and condenses on the print carrier located thereabove. By varying the magnitude of energy supplied, the quantity of vapor can be modified in a defined manner. In addition, it is possible to organize the film of water that arises in punctiform manner in its thickness.

It is particularly advantageous if the surface of the print carrier is charged with vapor in grid fashion and row-by-row, whereby a continuous processing of the print data driving the print machine is enabled.

In the following, the invention is explained in more detail on the basis for the drawings.

DESCRIPTION OF THE PREFERRED EMBODIMENTS

Figure 1:
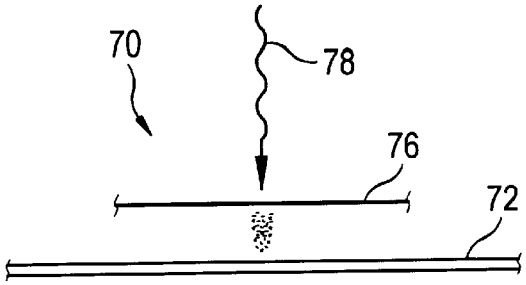
FIG. 1 shows a first embodiment of a unit for selective and partial vaporization of the surface of a print carrier.
Figure 2:
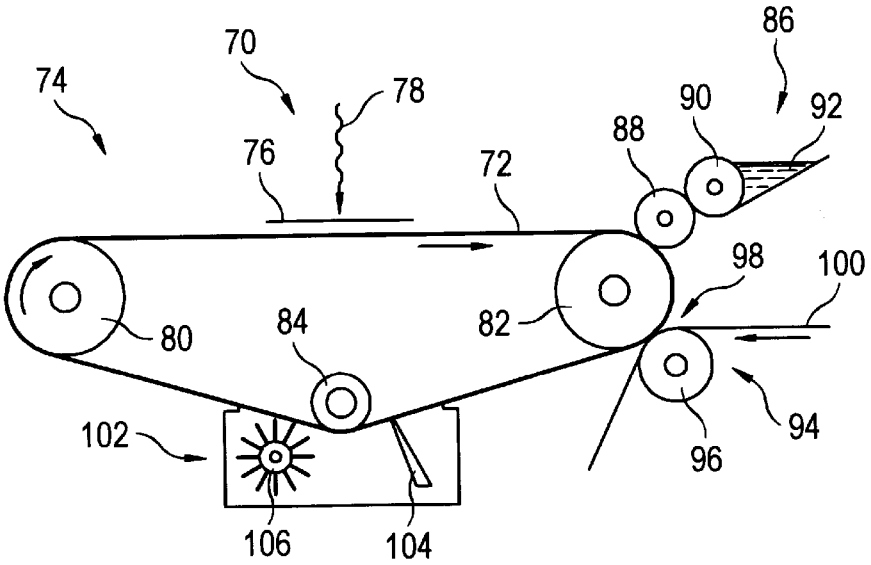
FIG. 2 shows a printing system in which the unit according to FIG. 1 is used.

FIG. 1 describes a first embodiment of a vaporization system 70 for the selective vaporization of the printing strip 72 of a printing means 74 (cf. FIG. 2). The vaporization unit 70 has a strip of fabric 76 that is driven in the direction of motion of the printing strip 72 and is arranged in parallel to the printing strip 72 at a slight distance. This strip of fabric is continuously moistened with water by means of a roller system having rollers 201 and 202, or alternatively the strip of fabric is continuously moistened with water by means of a spray unit 204 emitting the spray 205. On the side of the strip of fabric 76 facing away from the printing strip 72, a heating unit (not shown) is provided that extends approximately over the entire width of the printing strip 72, transverse to the direction of motion thereof. This heating unit has a plurality of sources of radiation 78 arranged next to one another in a row in the longitudinal direction of the heating unit which sources of radiation can be activated selectively and independent of one another.

FIG. 2 shows a schematic view of the printing unit 74 in which the first embodiment of the vaporization unit 70, specified in FIG. 1, is used. The printing unit 74 has a driven conveyor roller 80 that rotates in the clockwise direction and is shown at left in FIG. 2, as well as a printer roller 82 arranged at approximately the same height and shown at the right in FIG. 2, whose axis runs parallel to the axis of the conveyor roller 80. A deflecting roller 84 is provided approximately centrally positioned to the conveyor roller 80 and the printer roller 82, underneath these rollers and running parallel to them. The printing strip 72 is led over the conveyor roller 80, the printer roller 82 and the deflecting roller 84.

The vaporization unit 70 described in FIG. 1 is arranged above the conveyor roller 80 and the printer roller 82, approximately in the center between these. In the region of the printer roller 82, an inking station 86 is provided after the vaporization unit 70, seen in the direction of transport of the printing strip 72. This inking station 86 has an inking roller 88 that is applied to the printing strip 72 and is pre-stressed against the printing roller 82. A supply roller 90, which is applied under pre-stressing to the inking roller 88 and which dips into an ink container 92 filled with ink, supplies the inking roller 88 with ink. The transfer printing location 94 is provided immediately after the inking station 86, at which location a counter-pressure roller 96 is pre-stressed against the printing roller 82, applied to the printing strip 72 under pre-stressing. The counter-pressure roller 96 and the printer strip 72 applied to the printing roller 82 form a transport gap 98 through which the carrier material 100 is moved.

Finally, in the region of the deflecting roller 84 a cleaning unit 102 is arranged, seen in the direction of transport of the printer strip 72. The cleaning unit 102 has a stripper lip 104 applied to the printer strip 72 under pre-stressing and a subsequently arranged cleaning brush 106, which serve for the removal of water and residual ink on the printing face of the printer strip 72.

As soon as the printer unit 74 is activated, the radiation sources 78 of the heating unit begin to heat the strip of fabric 76, which is moistened with water, in selective and partial fashion, whereby the water stored in the strip of fabric 76 is vaporized and condenses onto the side of the printing strip 72 facing the strip of fabric 76. In this way, a partial film of water that reproduces the print image is formed on the surface of the printing strip 72. The printing strip 72, moistened in this way, is supplied to the inking station 86, in which the inking roller 88 applies ink to the surface of the printing strip 72. The regions not wetted with water are thereby inked, while the water in the regions wetted with water prevents an inking of these regions. After the inking of the printer strip 72, the inked segment of the printer strip 72 moves into the transfer printing location 94, in which the inked print image is printed directly on the carrier material 100 by means of the effect of the counter-pressure roller 96.

Figure 3:
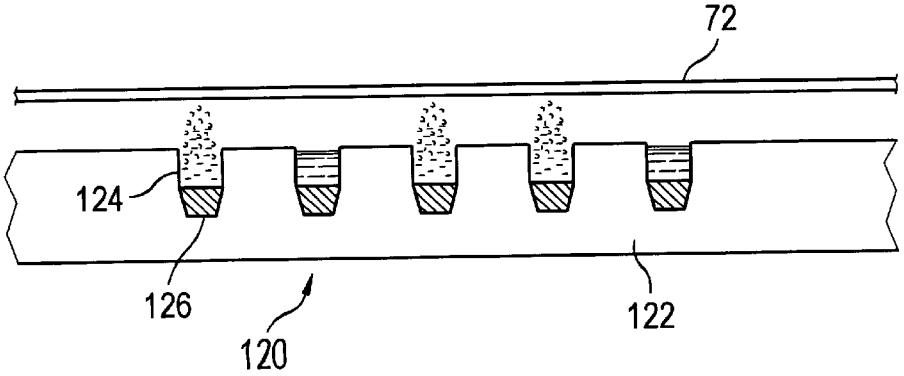
FIG. 3 shows a second embodiment of a unit that can be used for the selective and partial vaporization of the surface of the print carrier shown in FIG. 2.

FIG. 3 shows a second embodiment of a vaporization unit 120 that can be used in place of the vaporization unit 70 in the printing unit 74 shown in FIG. 2. The vaporization unit 120 has a heating rail 122 extending transverse to the direction of transport of the printing strip 72, over the entire width thereof. The heating rail 122 has in its longitudinal direction a plurality of cylindrical recesses 124 arranged next to one another in a row, respectively having a heating element 126 at their closed frontal side, and the respective open frontal side of which faces the printer strip 72. By means of selective activation of the heating elements 126, the water located in the respective recess 124 is heated so strongly that it vaporizes and condenses on the side of the printing strip 72 facing the heating rail 122, so that a partial film of water reproducing the print image is formed. Subsequently, the strip 72 wetted in this way, as already described above, is transported in the same way through the inking station 86 and the transfer printing location 94 in order to print the carrier material 100.

Although various minor changes and modifications might be proposed by those skilled in the art, it will be understood that our wish is to include within the claims of the patent warranted hereon all such changes and modifications as reasonably come within our contribution to the art.

What is claimed is:

1. A printing method for production of a print image on a carrier material, comprising the steps of:

arranging a vaporization unit with a water supply opposite a surface of a print carrier, the vaporization unit having a plurality of recesses with closed bottoms filled with water in which at least one heating element is respectively provided at the closed bottoms and spaced from an exit aperture of each recess;

selectively heating the heating elements corresponding to the print image;

charging the surface of the print carrier with water vapor from the vaporization unit at locations corresponding to structures of said print image to be printed;

condensing water vapor at said locations;

applying ink to the surface of the print carrier, the ink adhering to non-wetted locations and not being accepted by the wetted locations; and printing the ink from the non-wetted locations onto the carrier material.

2. The printing method according to claim 1 in which the surface of the print carrier is charged with vapor row-by-row, in the manner of a grid.

3. A printing system, comprising:

a movable print carrier, a surface of which is wetted with a film of water;

a vaporization unit arranged near the surface of the print carrier which charges the surface with water vapor corresponding to structures of a print image to be printed such that a partial film of water that reproduces the print image forms on the surface of the print carrier, the vaporization unit comprising a heating rail extending transverse to a direction of motion of the print carrier, having a plurality of recesses with closed bottoms filled with water, and a heating element being provided in each recess at the closed bottoms and spaced from an exit aperture of each recess; and an inking station arranged near the surface of the print carrier after the vaporization unit in a direction of motion of the print carrier for application of ink to the surface.

4. A printing method for production of a print image on a carrier material, comprising the steps of:

providing a vaporization unit with a water supply arranged opposite and beneath a surface of a print carrier, the vaporization unit having a plurality of recesses with closed bottoms filled with water in which at least one heating element is respectively provided at the closed bottoms and spaced from an exit aperture of each recess, the heating elements being selectively heated corresponding to the print image;

charging the surface of the print carrier with water vapor rising from the recesses at locations corresponding to structures of the print image to be printed;

condensing water vapor at said locations;

applying ink to the surface of the print carrier, the ink adhering to non-wetted locations and not being accepted by the wetted locations; and printing the ink from the non-wetted locations onto the carrier material.

5. A printing system, comprising:

a movable print carrier, a surface of which is wetted with a film of water;

a vaporization unit with a water supply arranged opposite and beneath a surface of the print carrier, the vaporization unit having a plurality of recesses filled with water in which at least one heating element is respectively provided at closed bottoms and spaced from an exit aperture of each recess, the heating elements being selectively heated corresponding to the print image;

a surface of the movable print carrier being wetted with a film of water as a result of rising vapor; and an inking station arranged near the surface of the print carrier after the vaporization unit in a direction of motion of the print carrier for application of ink to the surface.

6. A printing method for production of a print image on a carrier material, comprising the steps of:

arranging a strip of fabric moistened with water arranged opposite a surface of a print carrier, and selectively heating the strip of fabric using a radiation source at locations corresponding to structures of the print image to be printed;

charging the surface of the print carrier with water vapor from the strip of fabric at said locations;

condensing water vapor at said locations as a film of water;

applying ink to the surface of the print carrier, the ink adhering to non-wetted locations and not being accepted by the wetted locations; and printing the ink from the non-wetted locations onto the carrier material.

7. The printing method according to claim 6 in which the strip of fabric is moistened with water in a continuous movement.

8. The printing method according to claim 6 wherein the strip of fabric is moistened with water by use of a roller system.

9. The printing method according to claim 6 in which the strip of fabric is moistened with water by use of a spray unit.

10. The printing method according to claim 6 in which the surface of the print carrier is charged with vapor row-by-row, in the manner of a grid.

11. A printing system, comprising:

a movable print carrier, a surface of which is wetted with a film of water;

a vaporization unit arranged near the surface of the print carrier which selectively charges the surface with water vapor corresponding to structures of a print image to be printed such that a partial film of water that reproduces the print image forms on the surface of the print carrier, said vaporization unit comprising a strip of fabric that is moistened and is led past the surface of the print carrier at a slight distance, and that is selectively heated in partial fashion by means of a source; and an inking station arranged near the surface of the print carrier after the vaporization unit in a direction of motion of the print carrier for application of ink to the surface.

12. The system according to claim 11 wherein a cleaning unit is arranged before the vaporization unit in the direction of motion of the print carrier for cleaning the surface of the print carrier of residual water and ink.

13. The system according to claim 11 in which the print carrier is guided via at least two rollers.

14. The system according to claim 13 wherein at least one of the at least two rollers is driven.

15. The system according to claim 11 in which the print carrier comprises a driven printer roller.

16. The system according to claim 11 wherein the source comprises a radiation source.

17. The system according to claim 11 wherein the source comprises a heat source.

18. A printing system, comprising:

a movable print carrier, a surface of which is wetted with a film of water;

a vaporization unit comprising a strip of material moistened with water and which is selectively heated with a radiation source adjacent the strip of material arranged near the surface of the print carrier which charges the surface with water vapor corresponding to structures of a print image to be printed such that a partial film of water that reproduces the print image forms on the surface of the print carrier; and an inking station arranged near the surface of the print carrier after the vaporization unit in a direction of motion of the print carrier for application of ink to the surface.

* * * * *